US006546901B2

(12) United States Patent
Green

(10) Patent No.: US 6,546,901 B2
(45) Date of Patent: Apr. 15, 2003

(54) TWO CYCLE INTERNAL COMBUSTION ENGINE

(76) Inventor: William Delaplaine Green, 8906 Camden St., Alexandria, VA (US) 22308

( * ) Notice: Subject to any disclaimer, the term of this patent is extended or adjusted under 35 U.S.C. 154(b) by 0 days.

(21) Appl. No.: 09/922,685

(22) Filed: Aug. 7, 2001

(65) Prior Publication Data

US 2002/0050255 A1 May 2, 2002

Related U.S. Application Data

(60) Provisional application No. 60/223,310, filed on Aug. 7, 2000, provisional application No. 60/223,733, filed on Aug. 8, 2000, and provisional application No. 60/309,481, filed on Aug. 3, 2001.

(51) Int. Cl.[7] ..... F02B 33/36

(52) U.S. Cl. ..... 123/68; 123/65 V; 123/65 R; 123/65 BA; 123/65 P

(58) Field of Search ..... 123/68, 559.1, 123/65 V, 65 P, 65 BA, 65 R

(56) References Cited

U.S. PATENT DOCUMENTS 4,671,218 A * 6/1987 Weiland ..... 123/65 V
4,766,729 A * 8/1988 Miyajima ..... 60/598
4,998,525 A * 3/1991 Eftink ..... 123/559.1
5,375,581 A * 12/1994 Muller-Alander et al. ..... 123/559.1
5,893,355 A * 4/1999 Glover et al. ..... 123/559.1
5,911,211 A * 6/1999 Uchida ..... 123/559.1
6,029,637 A * 2/2000 Prior ..... 123/559.1

* cited by examiner

*Primary Examiner*—Willis R. Wolfe
*Assistant Examiner*—Rebecca A Smith

(57) ABSTRACT

A crankshaft driven positive displacement gear type air compressor enclosed within the engine housing forces air in between the compressor and reciprocating means. At approximately top dead center fuel is injected into the engine and burns. The high pressures of combustion transfer energy to the gears of the compressor and the reciprocating means and crankshaft assembly forcing them to accelerate. The reciprocating means accelerates to the bottom dead center position completely uncovering two exhaust ports. Exhaust passes through the exhaust ports and is scavenged with compressed air from the compressor flowing into the housing space enclosing the reciprocating means. The reciprocating means returns to the top dead center position compressing air in the housing space between the compressor and the reciprocating means. At approximately top dead center the process repeats itself.

21 Claims, 17 Drawing Sheets

TWO CYCLE INTERNAL COMBUSTION ENGINE

This is a utility application based upon provisional patent application Ser. No. 60/223,310 filed Aug. 7, 2000; patent application Ser. No. 60/223,733 filed Aug. 8, 2000 and provisional application Ser. No. 60/309,481 filed Aug. 3, 2001.

DISCLOSURE INFORMATION STATEMENT

In preparation for filing of this application, a pre-examination patent ability search was performed. Among the classes and subclasses reviewed were Class 123, subclasses 27R, 65B, 65BA, 68, 198C, 213, 257, 268, 316, 528, 533, 559.1, 561, 565, and 564. Computer searching was also done on the PTO patent database.

The search uncovered the following:

| Patent No. | Inventor | Date of Issue |
|---|---|---|
| 6,135,070 | R. A. Crandall | Oct. 24, 2000 |
| 5,878,703 | K. Sweeney | Mar. 9, 1999 |
| 5,746,163 | E. Green | May 5, 1998 |
| 5,388,561 | H. Cullum, J. Korn | Feb. 14, 1995 |
| 5,375,581 | G. Alander, H. Hofmann | Dec. 27, 1994 |
| 5,179,921 | V. Figliuzzi | Jan. 19, 1993 |
| 4,984,540 | K. Morikawa | Jan. 15, 1991 |
| 4,860,699 | J. Rocklein | Aug. 29, 1989 |
| 4,671,218 | C. Weiland | Jun. 9, 1987 |
| 4,539,948 | R. R. Toepel | Sep. 10, 1985 |
| 4,398,509 | E. Offenstadt | Aug. 16, 1983 |
| 2,851,021 | G. W. Covone | Sep. 9, 1958 |
| 2,708,919 | R. D. Wellington | May 24, 1955 |
| 2,686,503 | V. C. Reddy | Aug. 17, 1954 |
| 2,356,379 | D. F. Caris | Aug. 22, 1944 |
| 2,312,661 | D. Messner | March 2, 1943 |
| 2,067,984 | J. Ross | Jan. 19, 1937 |
| 2,062,621 | F. A. Truesdell | Dec. 1, 1936 |
| 1,720,414 | F. Gruebler | July 9, 1929 |
| 1,273,667 | J. A. Poyet | July 23, 1918 |
| 1,220,893 | B. A. Rundlof | Mar. 27, 1917 |

Designs for two stroke internal combustion engines are disclosed in the art that use positive displacement pumps to charge the cylinder with air prior to ignition. Compressed air is also used to scavenge the cylinder of combustion products during the exhaust cycle of the engine. Various methods of charging the cylinder with the compressed air produced by a positive displacement pump are disclosed in the art. Often a camshaft actuated poppet valve closing off the cylinder from the air passage leading from the air compressor is timed by the camshaft to open and allow the compressed air to enter the cylinder during part of the exhaust cycle to fill the cylinder and push out remaining exhaust gases before the exhaust port has closed.

One such design is disclosed in the U.S. Pat. No. 4,671,218 issued to Weiland. In this patent there is disclosed a gear type positive displacement pump used to charge a holding chamber located above the cylinder with compressed air through which a valve stem projects to the valve face that seals the intake port located in the floor of the holding chamber from the cylinder beneath it. A crankshaft driven camshaft actuates the intake valve while the exhaust ports are open, which are located in the cylinder wall just above the face of the piston when it is at bottom dead center, allowing compressed air from the compressor to fill the cylinder and scavenge the cylinder of remaining exhaust gases. While this design appears to be simple and straightforward it has the disadvantage of using a camshaft to operate the intake valve and such a design adds to the cost and complexity of the machine and diminishes its performance by using engine output to operate the camshaft and valve. It also has the disadvantage of fresh air being able to enter the open exhaust ports before they close since the camshaft is timed to open the intake valve and allow compressed air from the compressor into the cylinder while the exhaust ports are still open. This will reduce the temperature of the exhaust gases reducing the effectiveness of catalytic converters designed to reduce exhaust emissions, which require high exhaust temperatures for maximum effectiveness. The solution to this problem is a combustion-operated valve between the compressor and the cylinder, sealing the cylinder from the compressor outlet that eliminates the need for a camshaft and closes before fresh air from the compressor can reach the exhaust port. No means are shown to transfer the energy of combustion directly to the compressor gears during the power stroke of the engine. Such a valve exposes the compressor gears to the forces of combustion thereby producing a transfer of power to them during the power stroke of the engine The blower types described and illustrated in the patents found during a patent search are usually of the Roots type as disclosed in the Toepel Pat. No. 4,539,948, the Green Pat. No. 5,746,163 and several others, turbocharger designs as disclosed in the Toepel Patent and Sweeney Pat. No. 5,878,703 and others, or of the radial type as disclosed in the Rocklein Pat. No. 4,860,699, the Covone Pat. No. 2,851,021, and others. Only in the Weiland Patent and Figliuzzi Pat. No. 5,179,921 do we see a positive displacement gear pump used as a means to force air into the engine. In neither of these designs or in any of the other patents listed is shown an engine in which the compressor is located in the engine and directly compresses air between the compressor and the reciprocating means without the use of intervening valve means to separate the compressor from the combustion process. Nowhere is such a valve means shown that does not use crankshaft power to operate it.

It is therefore an important object of one embodiment the present invention to eliminate intake valves from a compressor charged two cycle engine by placing a positive displacement gear type air compressor in the engine head which compresses combustible material directly between the compressor and the reciprocating means thereby receiving a transfer of power to the compressor gears during the power stroke of the engine.

It is an important object of another embodiment of the present invention to eliminate the need for a camshaft to operate a valve between the compressor and the cylinder with such a valve controlled to prevent a flow of fresh air into the exhaust port during the exhaust process of the engine.

A third object of another embodiment of the present invention is to further simplify the engine design by combining the functions of the piston and rod into one reciprocating part to make the engine more durable.

SUMMARY OF THE INVENTION

The invention comprises a two-stroke internal combustion engine. The simplest embodiment having a housing made of two identical parts bolted together for easy manufacture, strength or assembly and disassembly. The housing has an intake port located in the uppermost wall of the housing for passing air into a gear type air compressor. The engine includes the air compressor formed by two partial cylinders enclosing the two gear shafts of the air compressor within the upper part of the housing below the intake port. The gear shafts output shafts pass through holes in the outer housing walls for the takeoff of power, and one of them is connected by rotational means connected to the output shaft of the crankshaft for a transfer of power between them. A passage for holding compressed air connects the outlet side of the air compressor to the top end of the cylinder confining the piston of the engine so the compressor gears and the piston are simultaneously exposed to the forces of combustion during the power cycle of the engine. A fuel injector nozzle is located in the intake port for injection of fuel into the passage. The piston is rotatably connected to the rod which is rotatably connected to a crankshaft located in the lower part of the housing space for converting the forces of combustion into useful torque. The crankshaft output shafts pass through identical holes in the walls of the housing. The crankshaft, gear shafts and reciprocating part have internal passages (not shown) for the passage of lubricant to areas of the engine requiring lubrication. Lubricant is pumped into these passages by a conventional oil pump, which is located in the bottom of the housing, to lubricate the engine. An exhaust port is located in the cylinder wall above the bottom dead center position of the piston face and allows exhaust gases to escape the cylinder after the power stroke. Fuel timing and pressure regulation means are provided to allow correct amounts of fuel to be injected into the engine at the proper intervals. This machine has an improved performance compared to other types of two cycle engines because the piston and the compressor gears are exposed simultaneously to the forces of combustion. The power generated by them is combined through power transfer means connecting an output shaft of the crankshaft to an output shaft of a gear shaft.

In any embodiment of this invention conventional sensors and engine management systems can be included to produce optimum engine performance. A conventional oil pump and oiling system can be included to provide oil to the cylinder walls, crankshaft bearings, rod bearings and gear shaft output rod bearings, conventional bearings means included for support of rotating parts. Conventional fuel supply means for supply of fuel to the fuel injector, conventional spark ignition means can be included to ignite the fuel and air mixture. A water jacket can be included to provide cooling means to embodiments that do not include a water jacket and if necessary an engine driven water pump included to circulate water through the water jacket and a radiator if needed, a fan to circulate air through the radiator.

This discussion has outlined some of the more important objects of the invention. These objects should be construed as illustrative of the more salient features and applications of the present invention. Many other important results can be obtained by applying the disclosed invention in different ways and modifying it within the scope of the disclosure. Accordingly, by referring to the detailed descriptions of the various embodiments taken together with the accompanying drawings and claims a more complete understanding of the invention may be ascertained.

BRIEF DESCRIPTION OF THE DRAWINGS (SUBMITTED WITH PRELIMINARY DRAWINGS)

DESCRIPTION OF THE PREFERRED EMBODIMENTS

Figure 1:
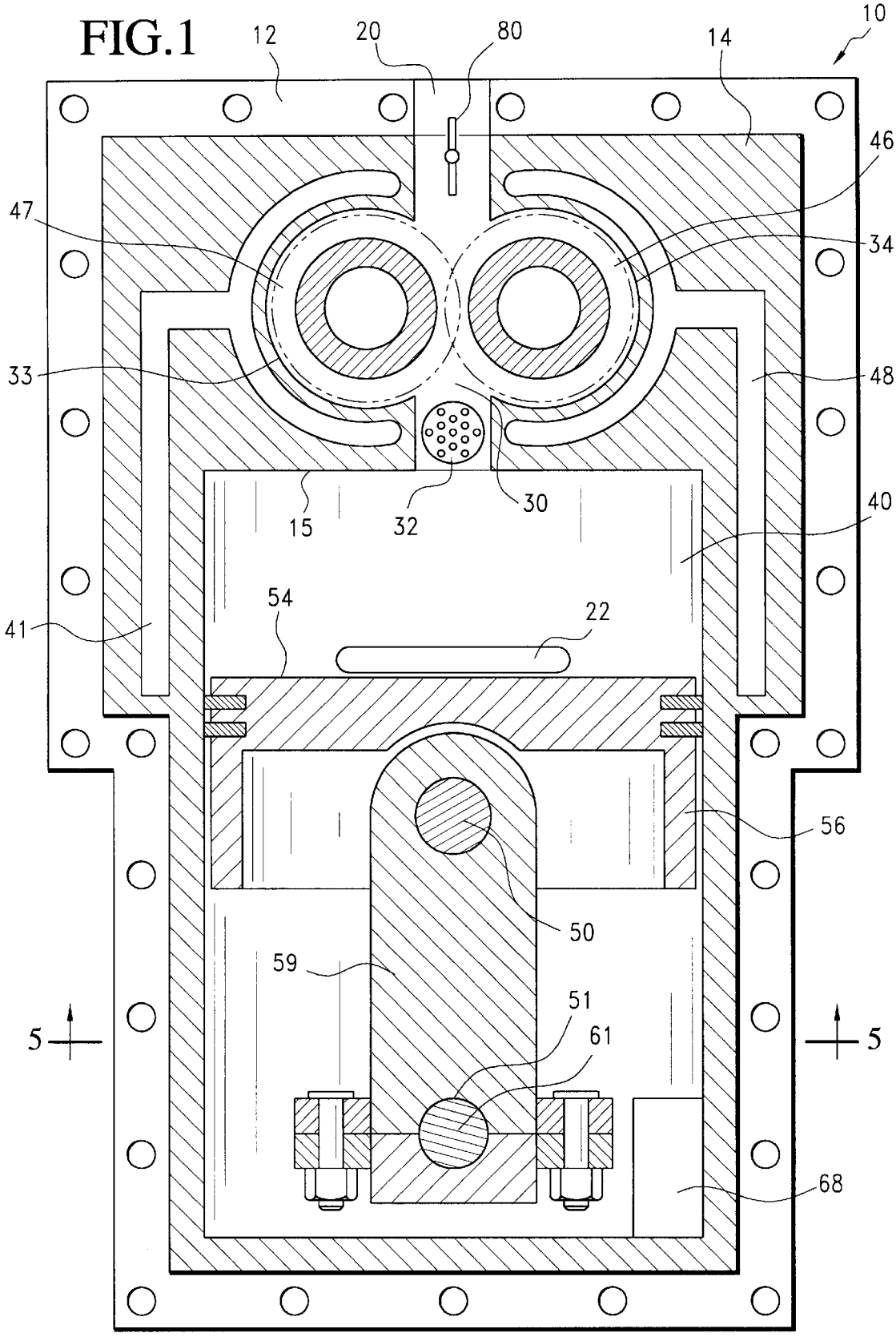
FIG. 1 is a side section view through a two-cycle internal combustion engine in accordance with one embodiment of the invention.
Figure 2:
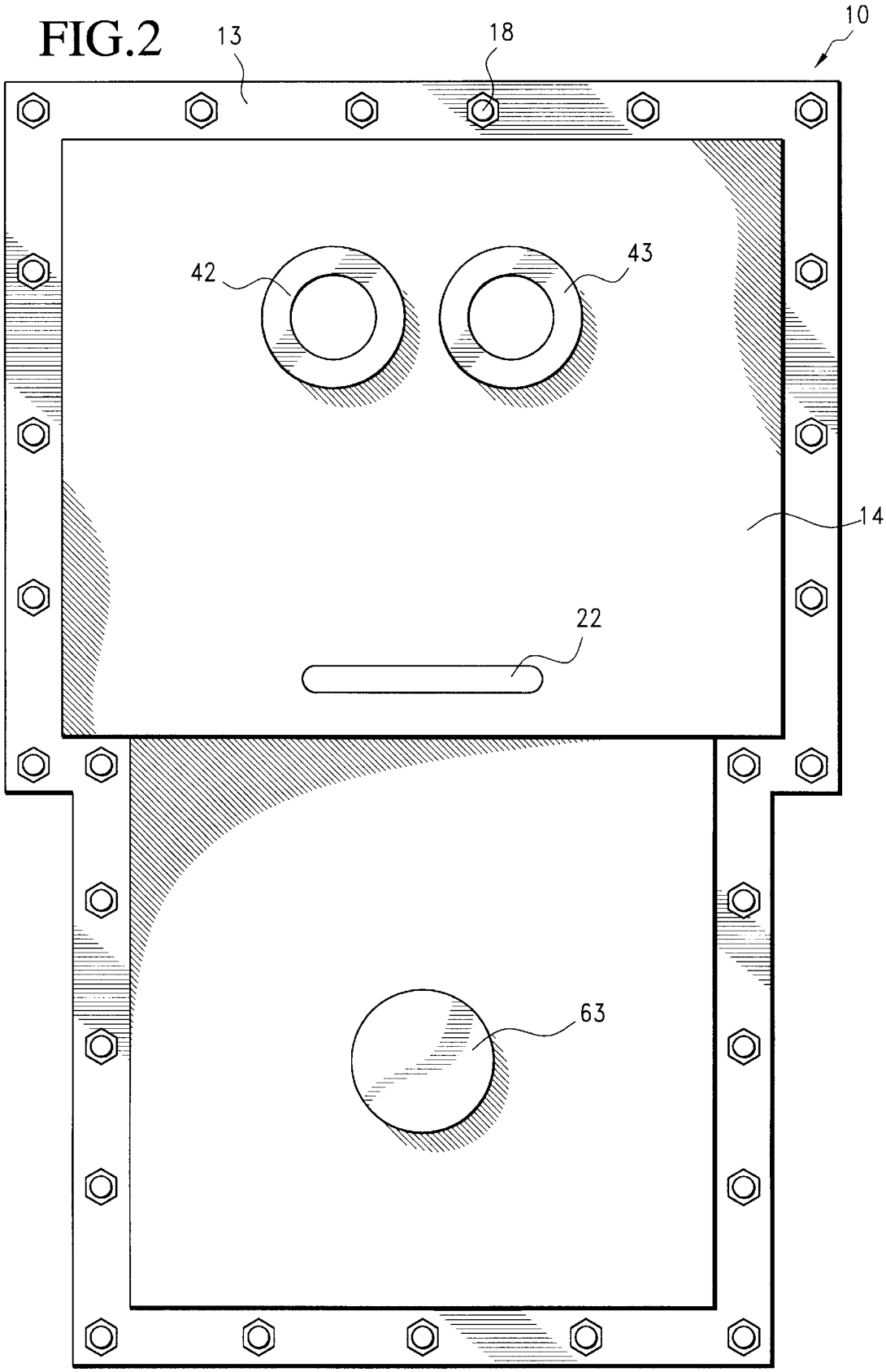
FIG. 2 is a side elevation view of the internal combustion engine shown in FIG. 1.
Figure 3:
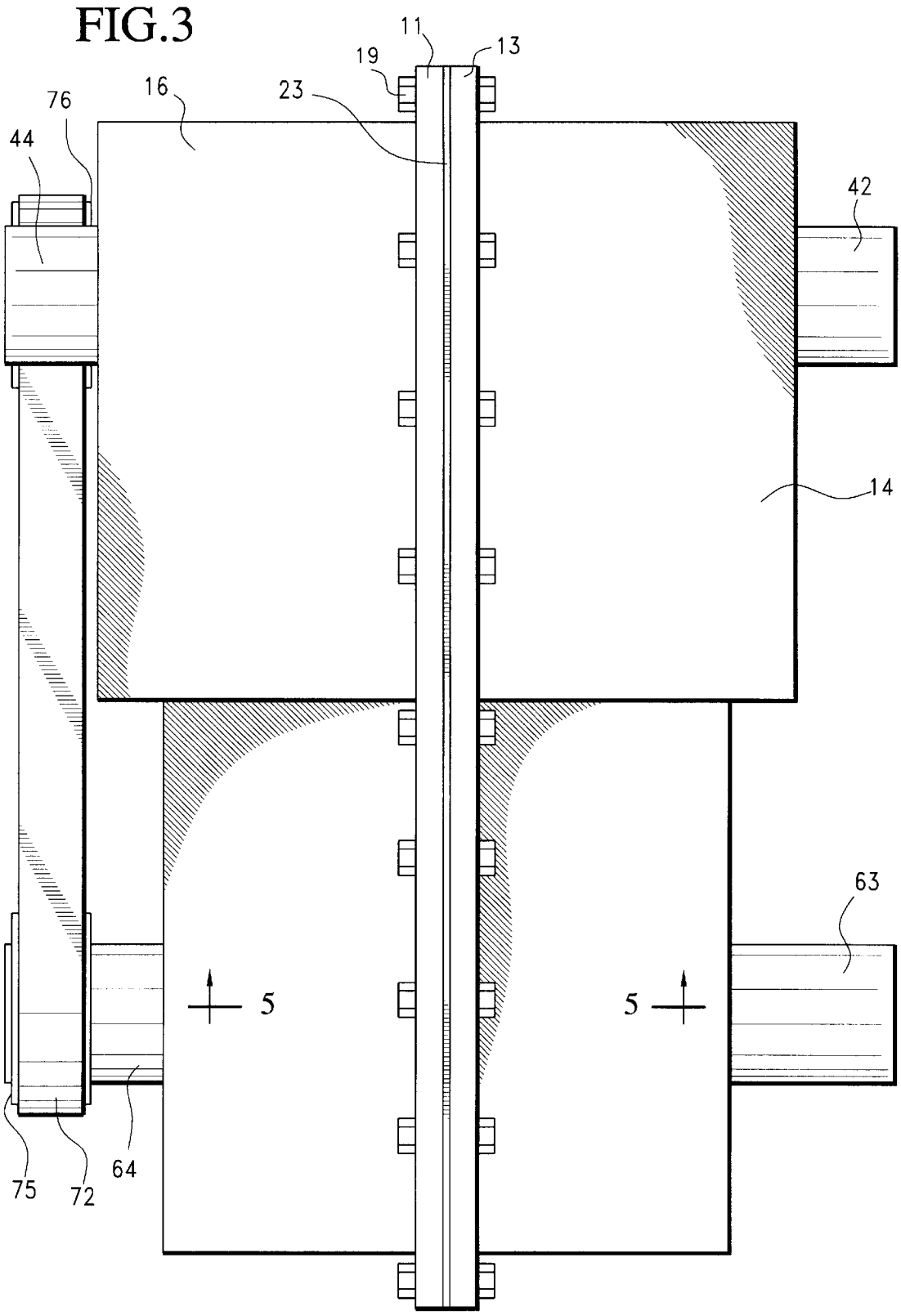
FIG. 3 is a side elevation view of the internal combustion engine shown in FIG. 1.
Figure 4:
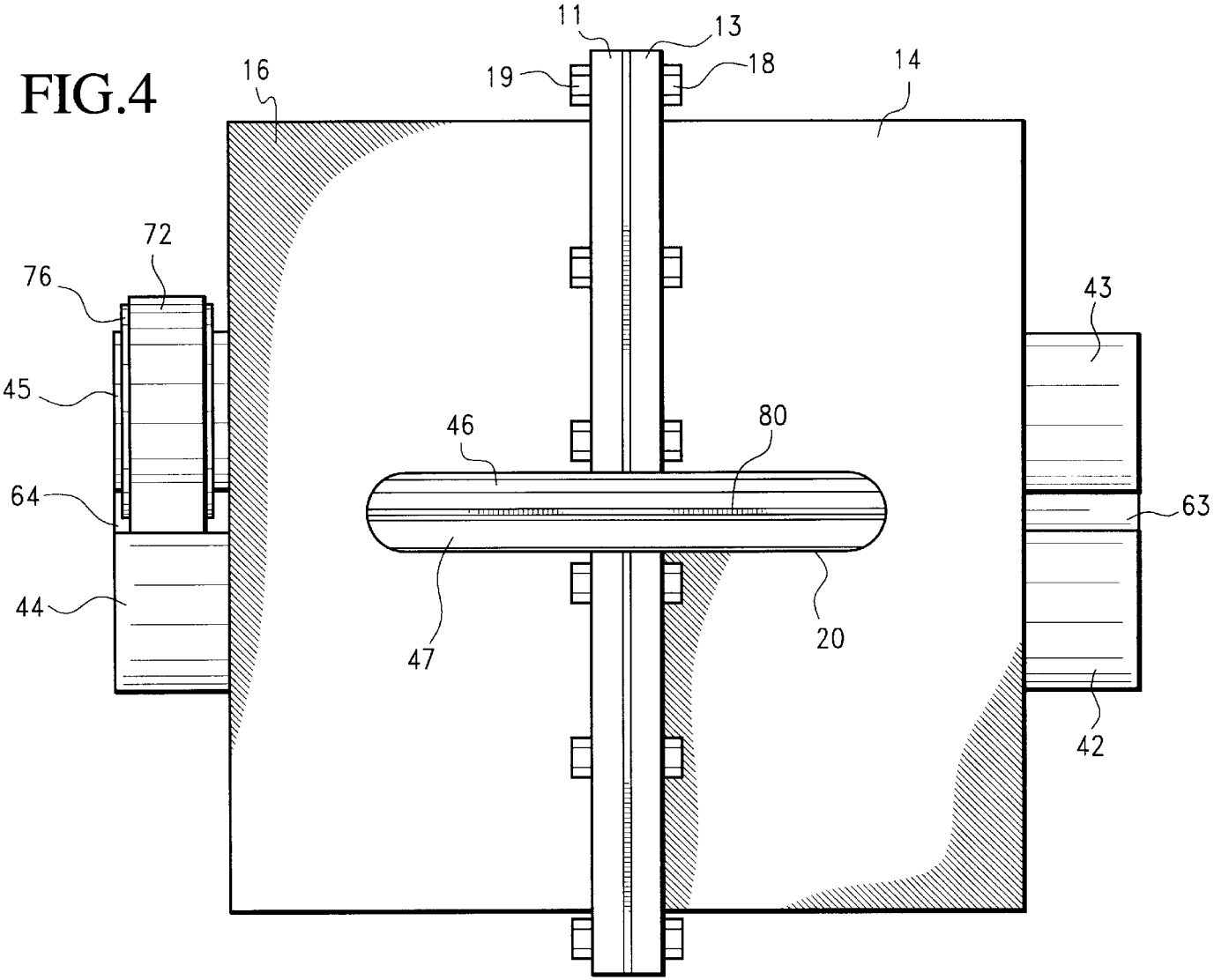
FIG. 4 is a top plan view of the internal combustion engine shown in FIG. 1.
Figure 5:
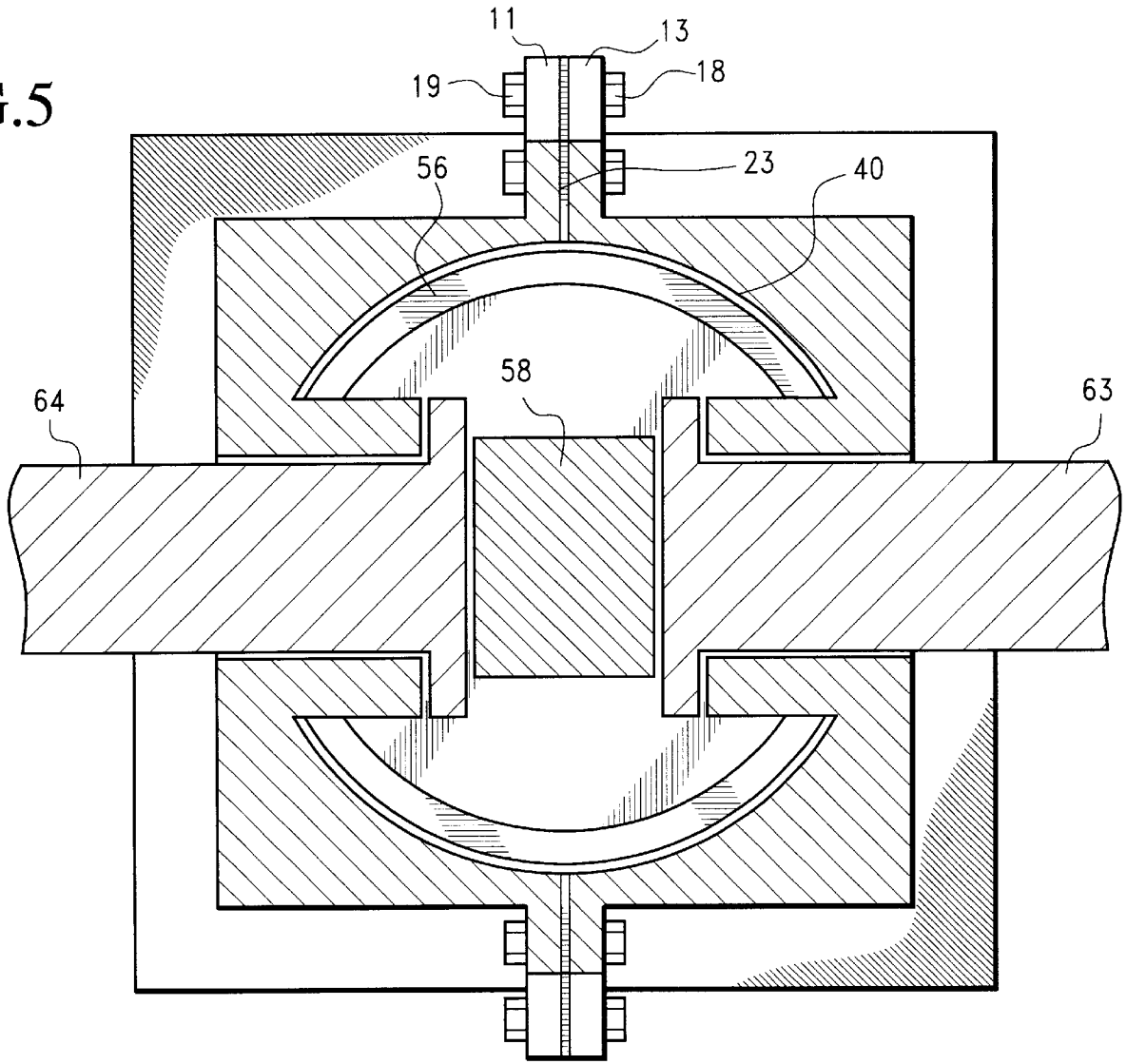
FIG. 5 is a transverse section view taken through a plane indicated by section line 5—5 in FIG. 1.
Figure 6:
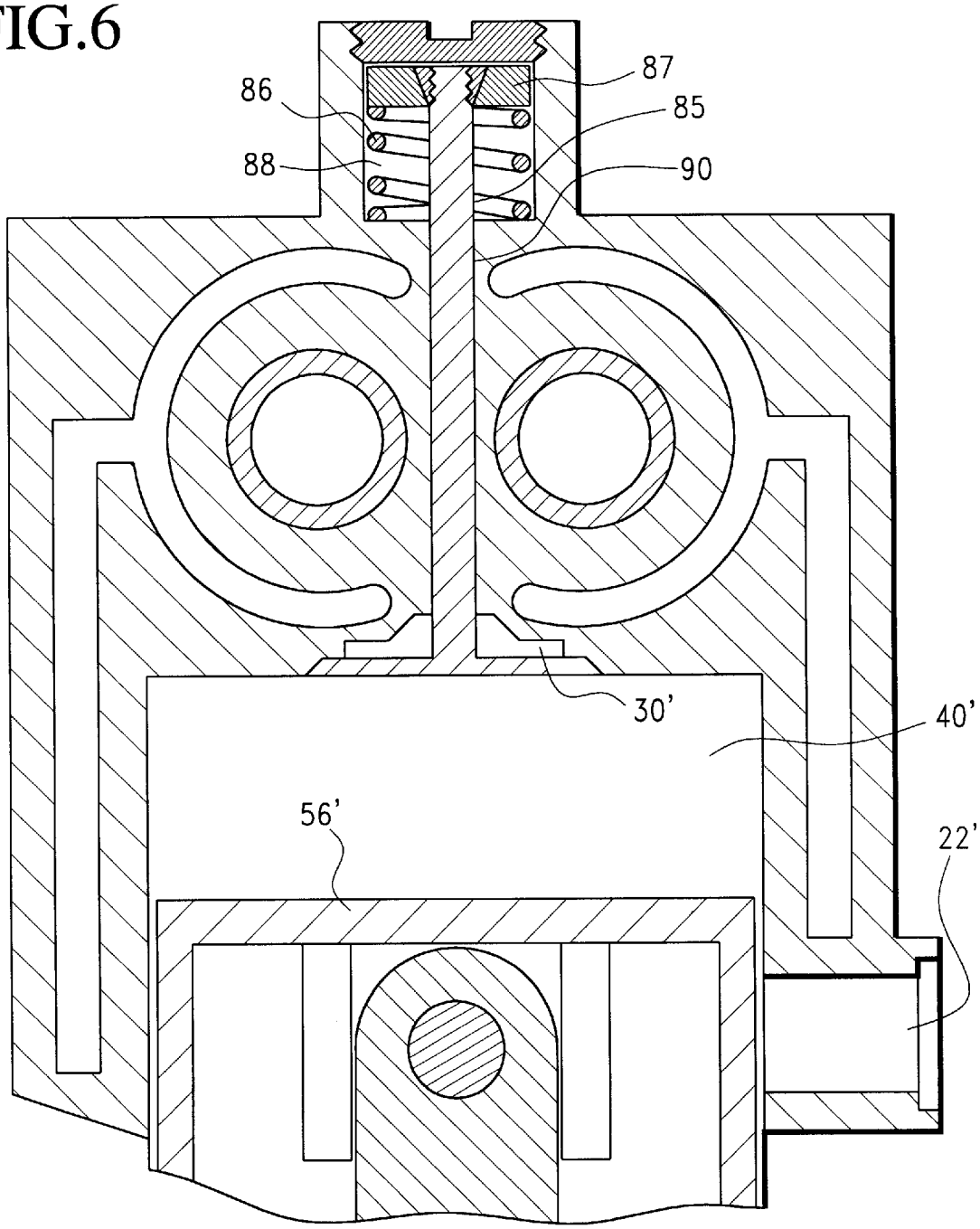
FIG. 6 is a partial side section view through a two-cycle internal combustion engine in accordance with one embodiment of the invention.

Referring now to the drawings in detail, FIG. 1–6 illustrate a two-cycle internal combustion engine constructed in accordance with one embodiment generally referred to by reference number 10. In this embodiment the engine is enclosed by a housing assembly 12, which is formed from two housing sections, 14 and 16. Bolts 19 pass through holes 17 in the flanges 11 and 13 surrounding sections 14 and 16 and nuts 18 secure the two housing sections against gasket 23. As clearly illustrated in FIG. 1 and FIG. 4 an intake port 20 is formed in the top wall of housing sections 14 and 16. The lower end of intake port 20 connects to two parallel partial cylinders 33 and 34 formed in housing section 14 and in housing section 16. They are parallel with the crankshaft and contain hollow gear shafts 46 and 47 (teeth not shown in side section views) which are meshed together as can be more clearly seen in FIG. 4. Gear shafts 46 and 47 have output shafts 42, 43, 44 and 45 extending through holes formed in the outer vertical walls of housing section 14 and 16. The gear shafts 46 and 47 are crankshaft driven, counter rotating in opposite directions drawing intake air through intake port 20 and force the intake air into passage 30 from which it passes into cylinder 40. A fuel injector 32 projects into passage 30 through the rear wall of housing section 14 for injecting fuel into passage 30. Partial cylinders 33 and 34 are centrally connected at their lower side to outlet passage 30 traversing the length of partial cylinders 33 and 34 within housing sections 14 and 16 and extending through internal housing wall 15 to cylinder 40 that contains piston 56. As illustrated in FIG. 1 and FIG. 5 formed within the cylinder 40 is a horizontal generally elongated exhaust port 22 passing through housing section 14 and having flat upper and lower horizontal sides and curved vertical sides. The lower horizontal side of exhaust port 22 is aligned horizontally with upper horizontal surface face 54 of piston 56 when piston 56 is positioned at bottom dead center within cylinder 40. As can be more clearly seen in FIG. 1 and FIG. 6, piston 56 has an upper exterior horizontal surface face 54, a circular exterior curved surface 53 tangent with the wall of cylinder 40. Piston 56 is rotatably connected to connecting rod 59 rotatably connected to rod journal 61 of crankshaft 65. As can be seen more clearly in FIG. 2, FIG. 3 and FIG. 5 the crankshaft output shafts 63 and 64 pass through holes in housing section 14 and 16 for external power transfer from the crankshaft. Crankshaft output shaft 64 is centrally attached to a drive pulley 75. The power transfer belt 72 circumscribes drive pulley 75 and extends around drive pulley 76, which is attached to the output shaft 45 of gear shaft 47. An oil pump 68 pumps oil through passages in the engine to areas of the engine requiring lubrication. Coolant flows through water jackets 41 and 48 to remove excess heat from the engine. The other necessary cooling means are not shown on the engine. Throttle plate 80 is located in the intake 20 to control the amount of air the engine receives.

During operation of the engine the crankshaft output shaft 64 rotates the drive pulley 75 transferring power to the drive belt 72 causing drive pulley 76, which is attached to gear shaft output shaft 45, to rotate and turn gear shaft 47. The teeth of gear shaft 47 rotate and force the teeth of gear shaft 46 to move forcing rotation of gear shaft 46. The rotation of the gear shafts 46 and 47, which are closely confined within parallel partial cylinders 33 and 34 moves air received from intake port 20 along the circumference of partial cylinders 33 and 34 and into passage 30 from which it passes into cylinder 40. As crankshaft 65 rotates piston 56 is pushed by crankshaft connecting rod 59 towards internal horizontal housing wall 15, thereby reducing the volume within cylinder 40 and compressing the air held therein between piston 56 and rotating gear shafts 46 and 47 of the air compressor. When piston 56 reaches approximately top dead center the fuel injector 32 injects fuel into passage 30 containing the compressed air from the compressor. The high temperature of the compressed air confined within passage 30 ignites the incoming fuel mixture from the compressor.

The forces of combustion transfer energy to the teeth of gear shafts 46 and 47 and to the piston 56 simultaneously causing these parts to accelerate. The acceleration of the gear shafts 46 and 47, transfers power to their output shafts 42, 43, 44 and 45. The acceleration of the piston 56 transfers energy to the crankshaft 65 thereby transferring power to the output shafts 63 and 64 which is combined with the power output of the gear shaft output shaft 45 through power transfer belt 72. As the gear shafts 46 and 47 accelerate they pump more air into the engine for combustion causing greater power to be generated. The fuel injector 32 is timed to turn off before piston 56 passes below exhaust port 22 so the combustion occurring within cylinder 40 can finish before exhaust gases begin to pass out of the engine. Fresh air from the compressor enters cylinder 40 and scavenges it of exhaust gases while the exhaust port 22 is exposed to the volume of cylinder 40 above the face of piston 56 and fills that portion of cylinder 40 with fresh air. As piston 56 moves towards top dead center, air between the gear shafts 46 and 47 and piston 56 is compressed into passage 30 making the engine ready for another power stroke.

Figure 7:
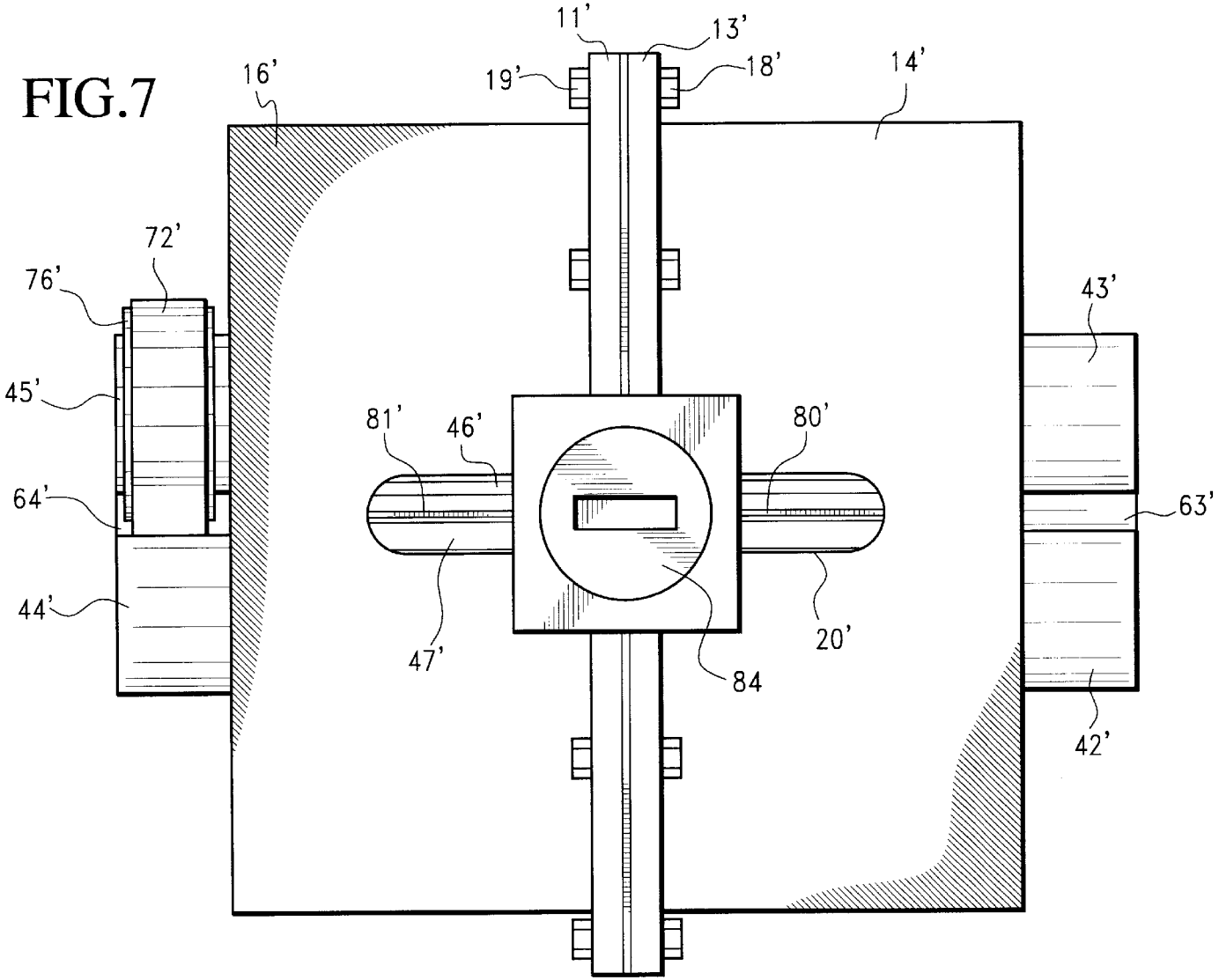
FIG. 7 is top plan view of the internal combustion engine shown in FIG. 6

FIGS. 7 illustrates a different embodiment of the described invention. FIG. 7 shows the embodiment wherein a poppet valve 85 seals passage 30' from cylinder 40'. The valve stem of poppet valve 85 projects upwards through housing section 14' and 16' into a compartment containing the helical spring 86 and retainer 87 that keep valve 85 tensioned against the bottom of the lower wall of passage 30. When combustion of the fuel and air in passage 30' occurs the forces of combustion push valve 85 down against the face of the piston 56' forcing it towards bottom dead center, there it uncovers exhaust port 22' and exhaust gases escape through it from the cylinder. The valve 85 closes when fuel injector 32 (not shown) stops injecting fuel into the engine at which time the fresh air from the compressor flowing into passage 30' burns the remaining fuel within passage 30' and the valve then closes. This design does not need a camshaft. The pressures that are caused by combustion occurring in passage 30' actuate valve 85. Throttles 80' and 81 control the amount of air flowing into the engine. Screw on cap 84 covers the compartment 88, containing helical spring 86, retainer 87 and the valve stem of valve 85. The valve stem of valve 85 passes through valve guide 90.

Figure 8:
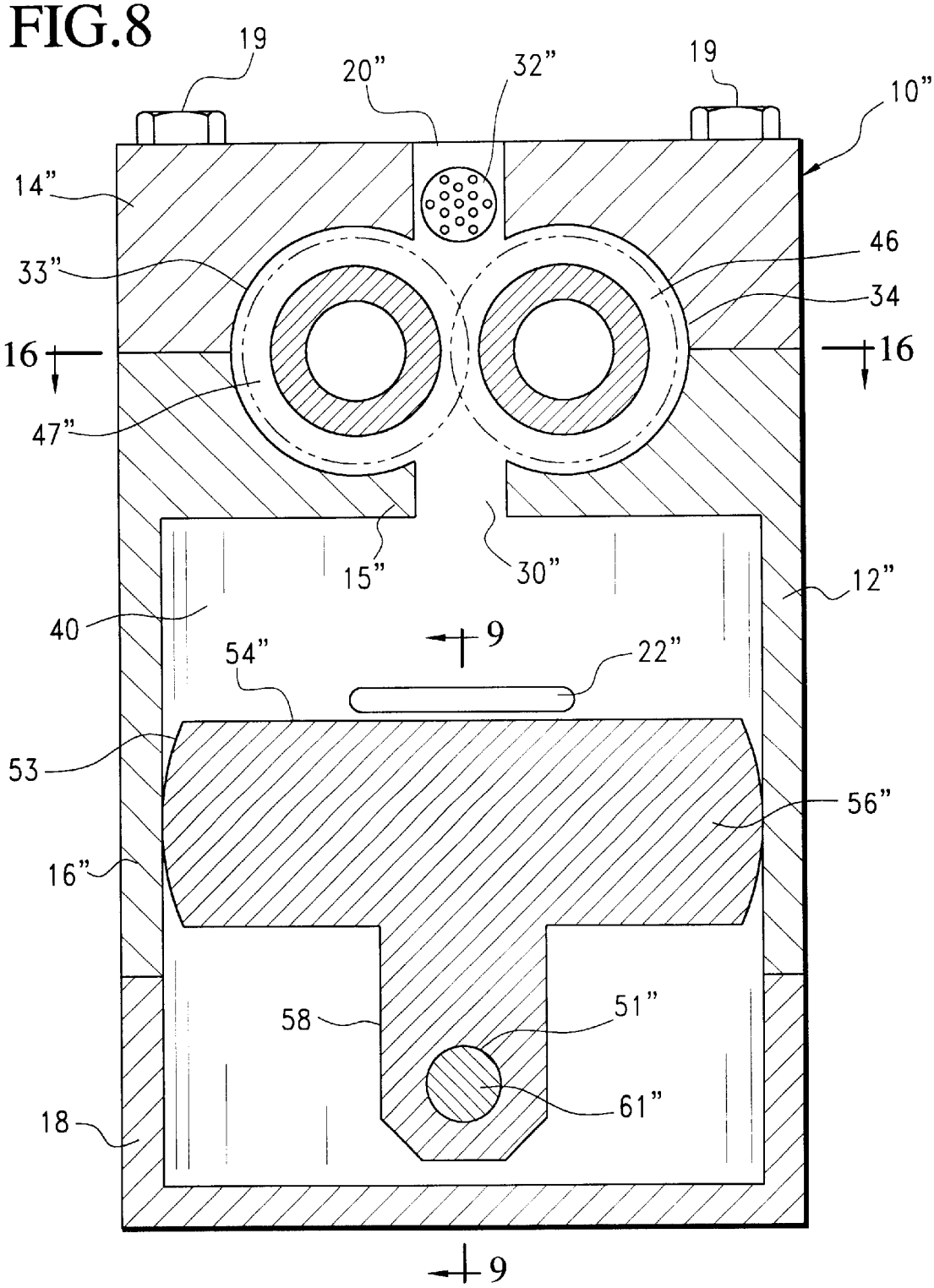
FIG. 8 is a side section view through a two-cycle internal combustion engine in accordance with one embodiment of the invention.
Figure 9:
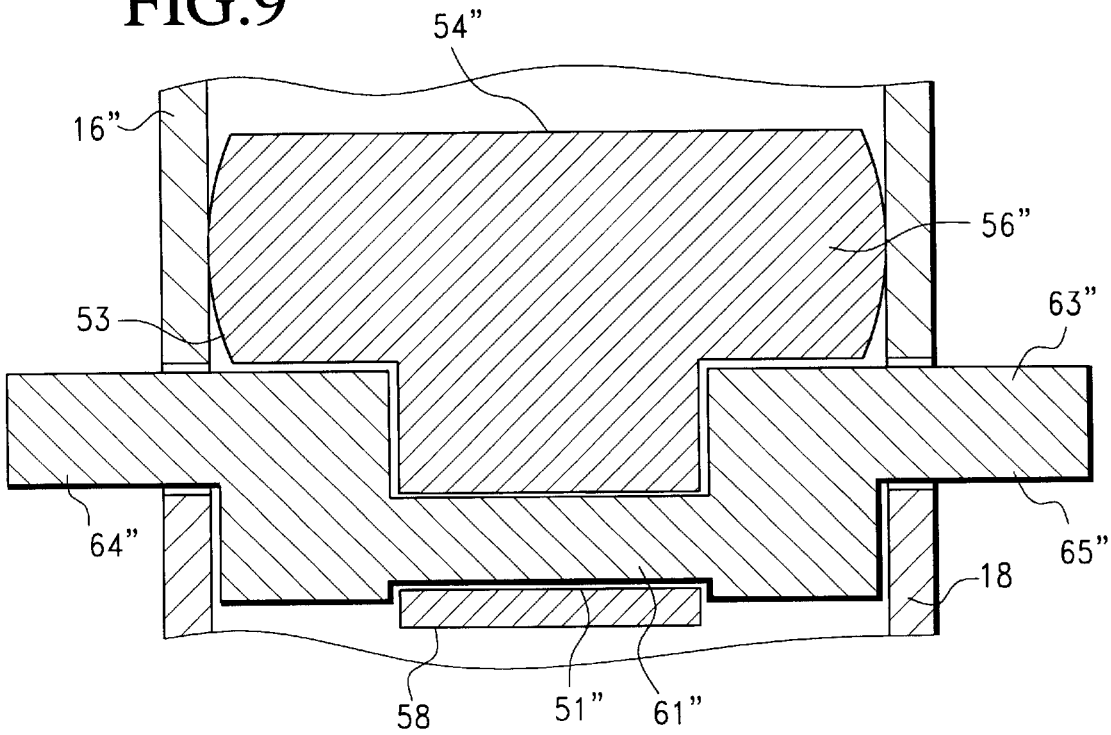
FIG. 9 is a partial side section view taken through a plane indicated by section line 2—2 in FIG. 1.
Figure 10:
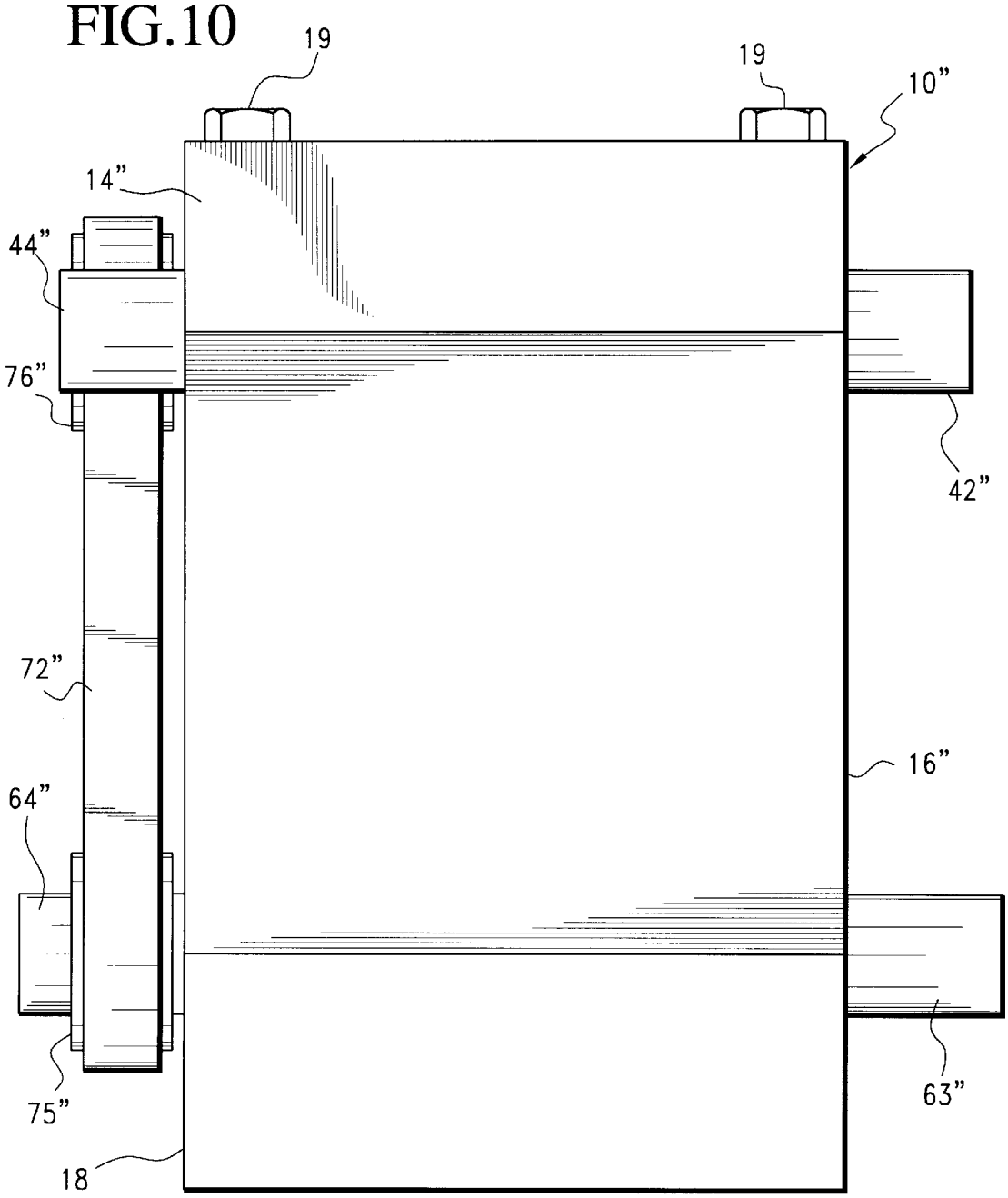
FIG. 10 is a side elevation view of the internal combustion engine shown in FIG. 1.
Figure 11:
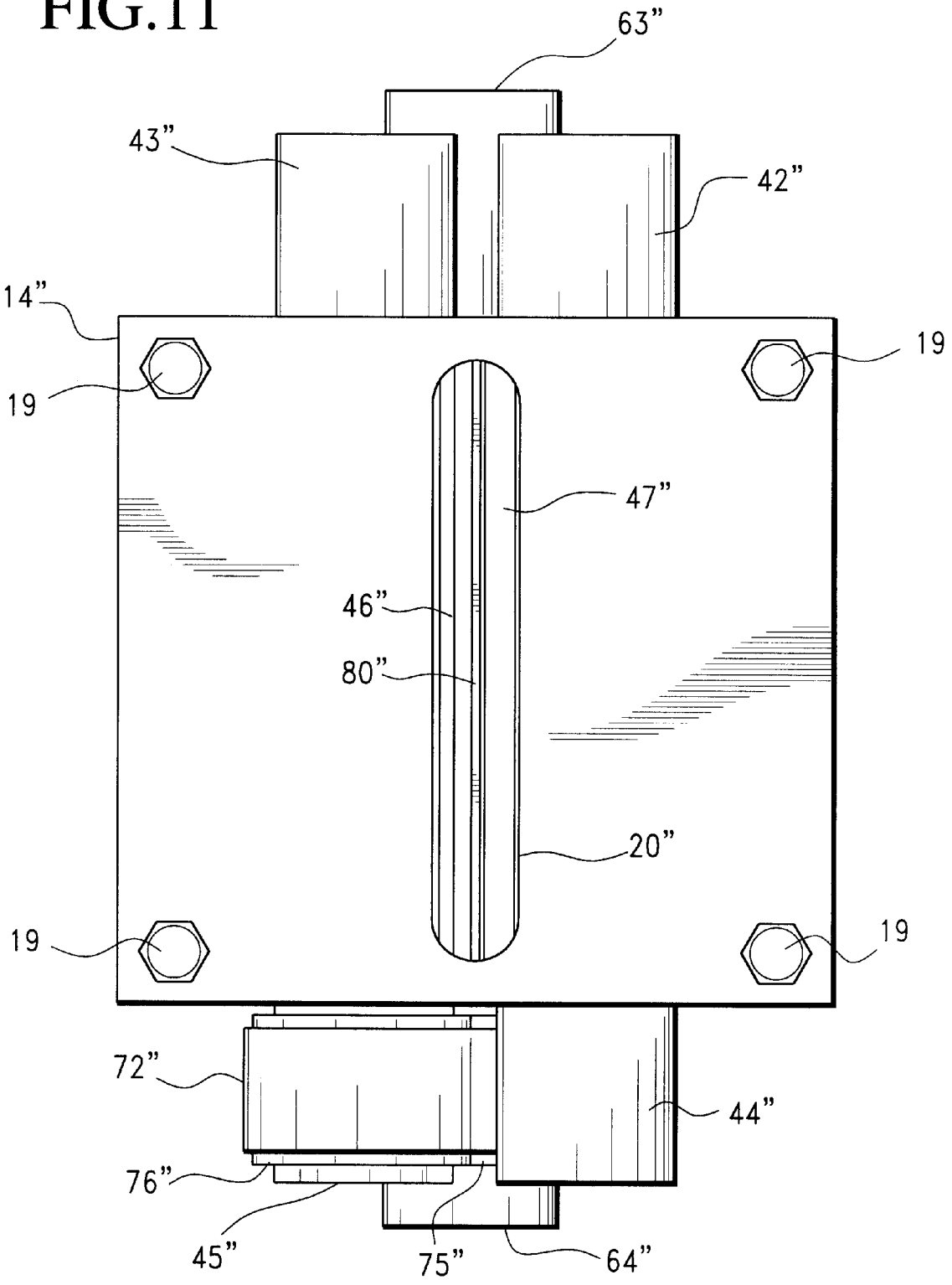
FIG. 11 is a top plan view of the internal combustion engine shown in FIG. 1.
Figure 12:
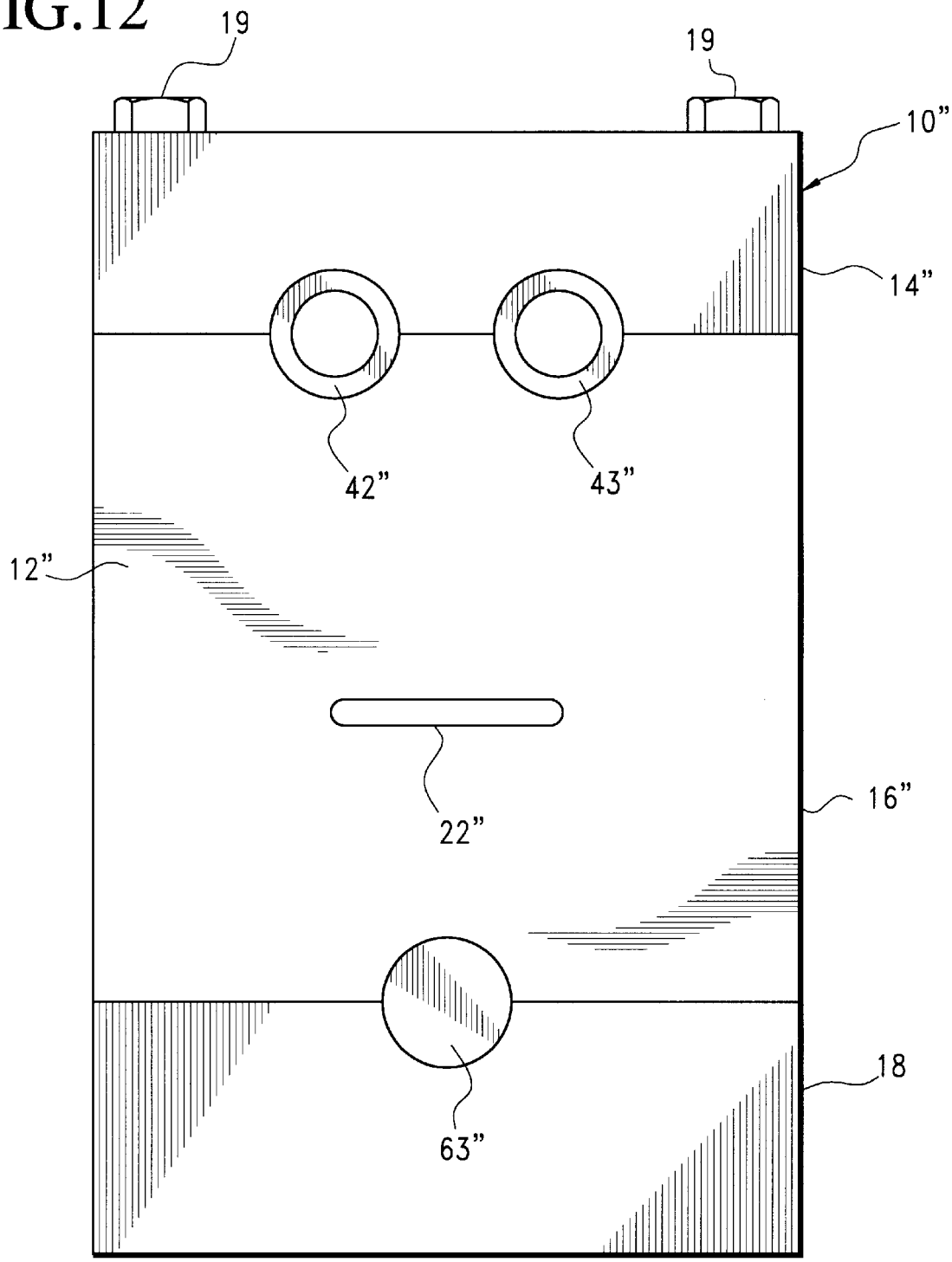
FIG. 12 is a side elevation view of the internal combustion engine shown in FIG. 1.

Referring now to the drawings in detail, FIGS. 8–17 illustrate a two-cycle internal combustion engine constructed in accordance with one embodiment generally referred to by reference number 10". In this embodiment the engine is enclosed by a housing assembly 12", which is formed from three housing sections, 14" and 16" and 18. Bolts 19" pass through holes 17" near the corners in sections 14" and 16" and thread into threaded holes passing through section 18 thereby bolting the three housing sections securely together. As clearly illustrated in FIG. 8 and FIG. 11 an intake port 20" is formed in the top wall of housing section 14", and a fuel injector 32" projects into intake port 20" through the rear wall of housing section 14" for injecting fuel into port 20". The lower end of intake port 20" connects to two parallel partial cylinders 33" and 34" formed in the bottom of housing section 14" and in the top of housing section 16". They are parallel with the crankshaft and contain hollow gear shafts 46" and 47" (teeth not shown in side section views) which are meshed together as can be more clearly seen in FIG. 11. Gear shafts 46" and 47" have output shafts 42", 43", 44" and 45" extending through holes formed in the outer vertical walls of housing section 14" and 16". The gear shafts 46" and 47" are crankshaft driven, counter rotating in opposite directions drawing intake air through intake port 20" and forcing the intake air into passage 30" from which it passes into cylinder 40". Partial cylinders 33" and 34" are centrally connected at their lower side to outlet passage 30" traversing the length of partial cylinders 33" and 34" within housing section 16" and extending through internal housing wall 15" to cylinder 40" that contains reciprocating part 56". As illustrated in FIG. 8 and FIG. 12 formed within the cylinder 40" is a horizontal generally elongated exhaust port 22" passing through housing section 16" and having flat upper and lower horizontal sides and curved vertical sides. The lower horizontal side of exhaust port 22" is aligned horizontally with upper horizontal surface face 54" of reciprocating part 56" when reciprocating part 56" is positioned at bottom dead center within cylinder 40". As can be more clearly seen in FIG. 8 and FIG. 9 reciprocating part 56" has an upper exterior horizontal surface face 54", a circular exterior curved surface 53" that is tangent with the wall of cylinder 40" and a lower depending section 58. Lower depending section 58 has a transverse bearing hole 51" formed therein surrounding rod journal 61 of crankshaft 65". The upper section of reciprocating part 56" has a sectioned ball shape having a slightly smaller diameter than the cylinder diameter so it can rotate and slide within cylinder 40" with lower section 58 acting as lever arm that forces the rotation of upper section having curved sides 53. The reciprocating part 56" and crankshaft 65" are assembled together so the reciprocating part can be one solid part. When crankshaft 65" rotates reciprocating part 56" rotates and the exterior curved surface 53 rotates as it slides up and down the cylinder wall 40 allowing constant contact with the wall of cylinder 40". As can be seen more clearly in FIG. 9, FIG. 10 and FIG. 12 the crankshaft output shafts 63" and 64" pass through holes in housing section 16" and 18 for external power transfer from the crankshaft. Crankshaft output shaft 64 is centrally attached to a drive pulley 75". The power transfer belt 72" circumscribes drive pulley 75" and extends around drive pulley 76", which is attached to the output shaft 45" of gear shaft 47".

During operation of the engine the crankshaft output shaft 64" rotates the drive pulley 75" transferring power to the drive belt 72" causing drive pulley 76", which is attached to gear shaft output shaft 45", to rotate and turn gear shaft 47". The teeth of gear shaft 47" rotate and force the teeth of gear shaft 46" to move forcing rotation of gear shaft 46". The rotation of the gear shafts 46" and 47", which are closely confined within parallel partial cylinders 33" and 34" moves air received from intake port 20" along the circumference of partial cylinders 33" and 34" and into passage 30" from which it passes into cylinder 40". As crankshaft 65" rotates reciprocating part 56" is pushed by crankshaft rod journal 61" towards internal horizontal housing wall 15", thereby reducing the volume within cylinder 40" and compressing the air held therein between reciprocating part 56" and rotating gear shafts 46" and 47" of the air compressor. When reciprocating part 56" reaches approximately top dead center the fuel injector 32" injects fuel into the incoming air stream within intake port 20" and the fuel flows with the air into the air compressor. The air compressor discharges the fuel and air mixture received from intake port 20" into passage 30" containing the compressed air from the compressor. The high temperature of the compressed air confined within passage 30" ignites the incoming fuel mixture from the compressor. The forces of combustion transfer energy to the teeth of gear shafts 46" and 47" and to the reciprocating part 56" simultaneously causing these parts to accelerate. The acceleration of the gear shafts 46" and 47" transfers power to their output shafts 42", 43", 44" and 45". The acceleration of the reciprocating part transfers energy to the crankshaft 65" thereby transferring power to the output shafts 63" and 64" which is combined with the power output of the gear shaft output shaft 45" through power transfer belt 72". As the gear shafts 46" and 47" accelerate they pump more air into the engine for combustion causing greater power to be generated. The fuel injector 32" is timed to turn off before reciprocating part 56" passes below exhaust port 22" so the combustion occurring within cylinder 40" can finish before exhaust gases begin to pass out of the engine. Fresh air from the compressor enters cylinder 40" and scavenges it of exhaust gases while the exhaust port 22" is exposed to the volume of cylinder 40" above the face of reciprocating part 56" and fills that portion of cylinder 40" with fresh air. As reciprocating part 56" moves towards top dead center, air between the gear shafts 46" and 47" and reciprocating part 56" is compressed into passage 30" making the engine ready for another power stroke.

Figure 13:
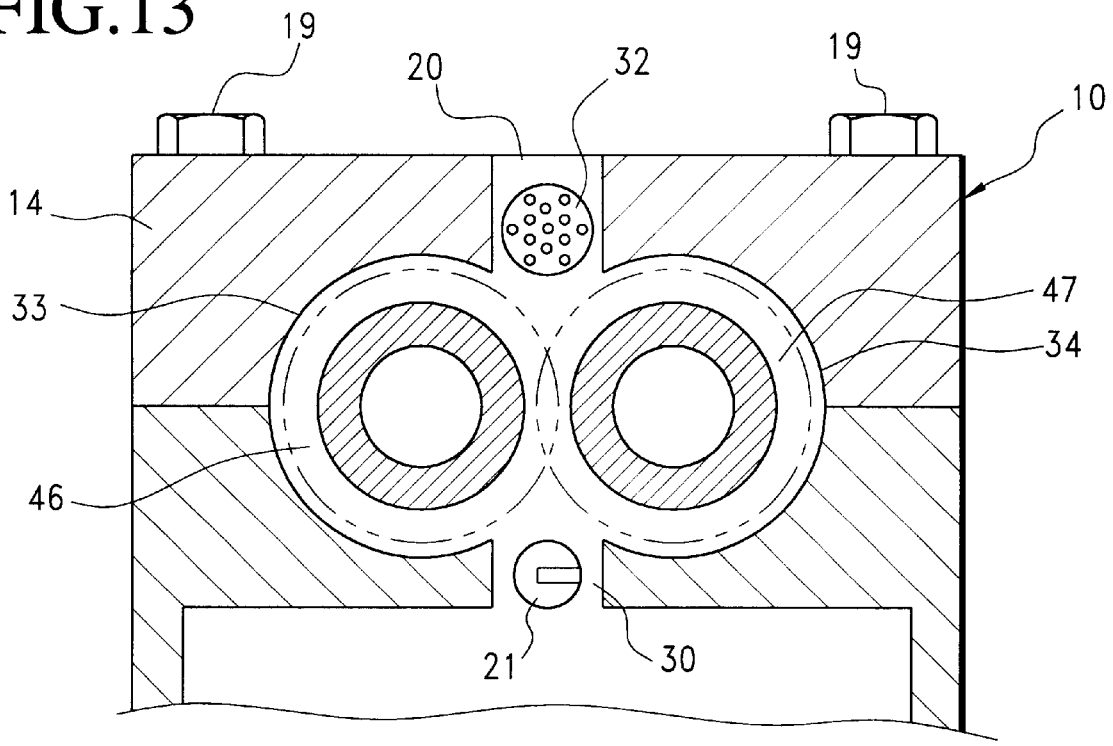
FIG. 13 is a partial side section view through a two-cycle internal combustion engine in accordance with one embodiment of the invention.
Figure 14:
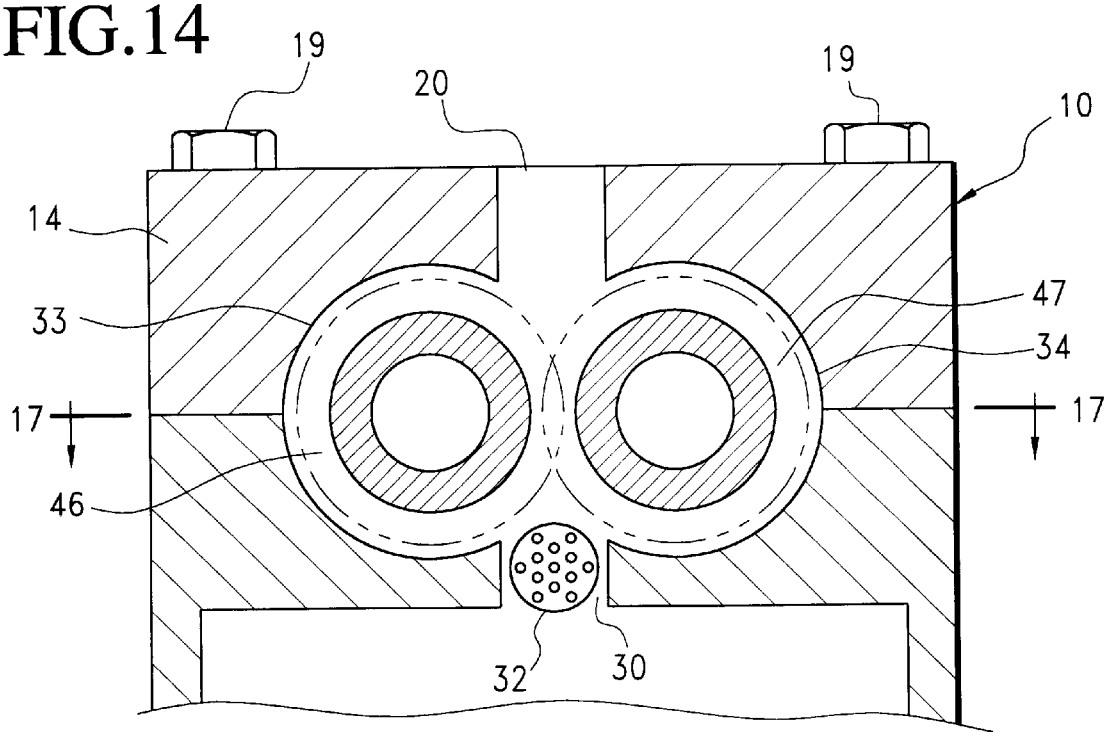
FIG. 14 is a partial side section view through a two-cycle internal combustion engine in accordance with one embodiment of the invention.
Figure 15:
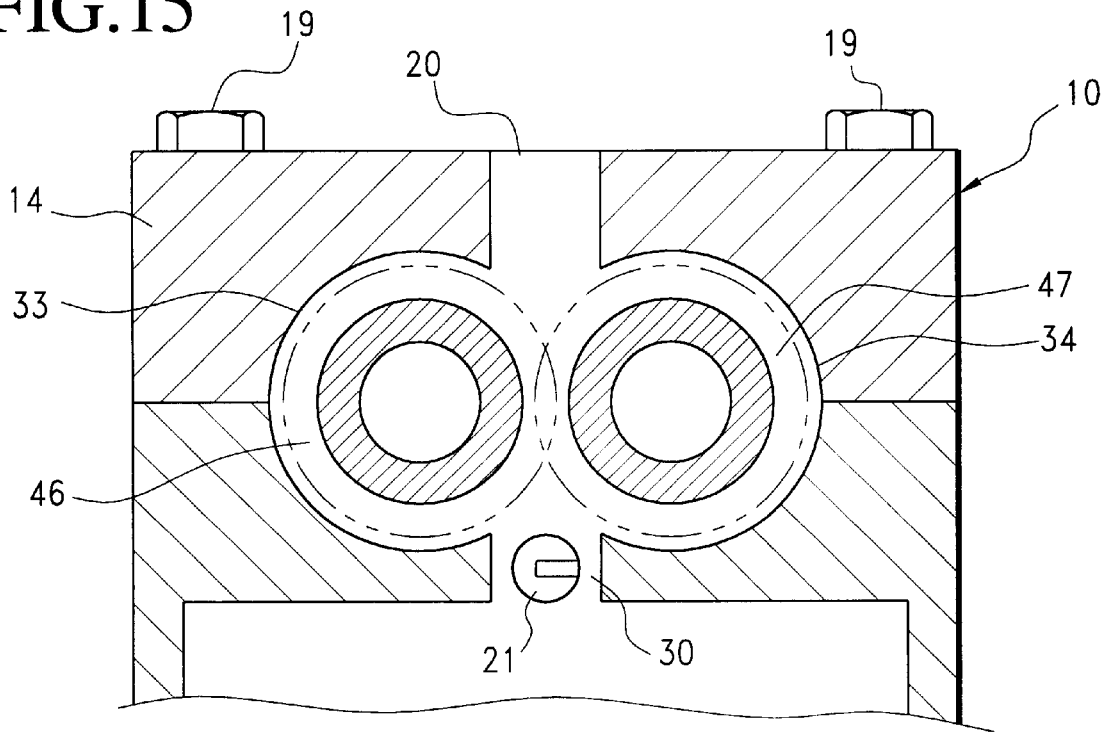
FIG. 15 is a partial side section view through a two-cycle internal combustion engine in accordance with one embodiment of the invention.
Figure 16:
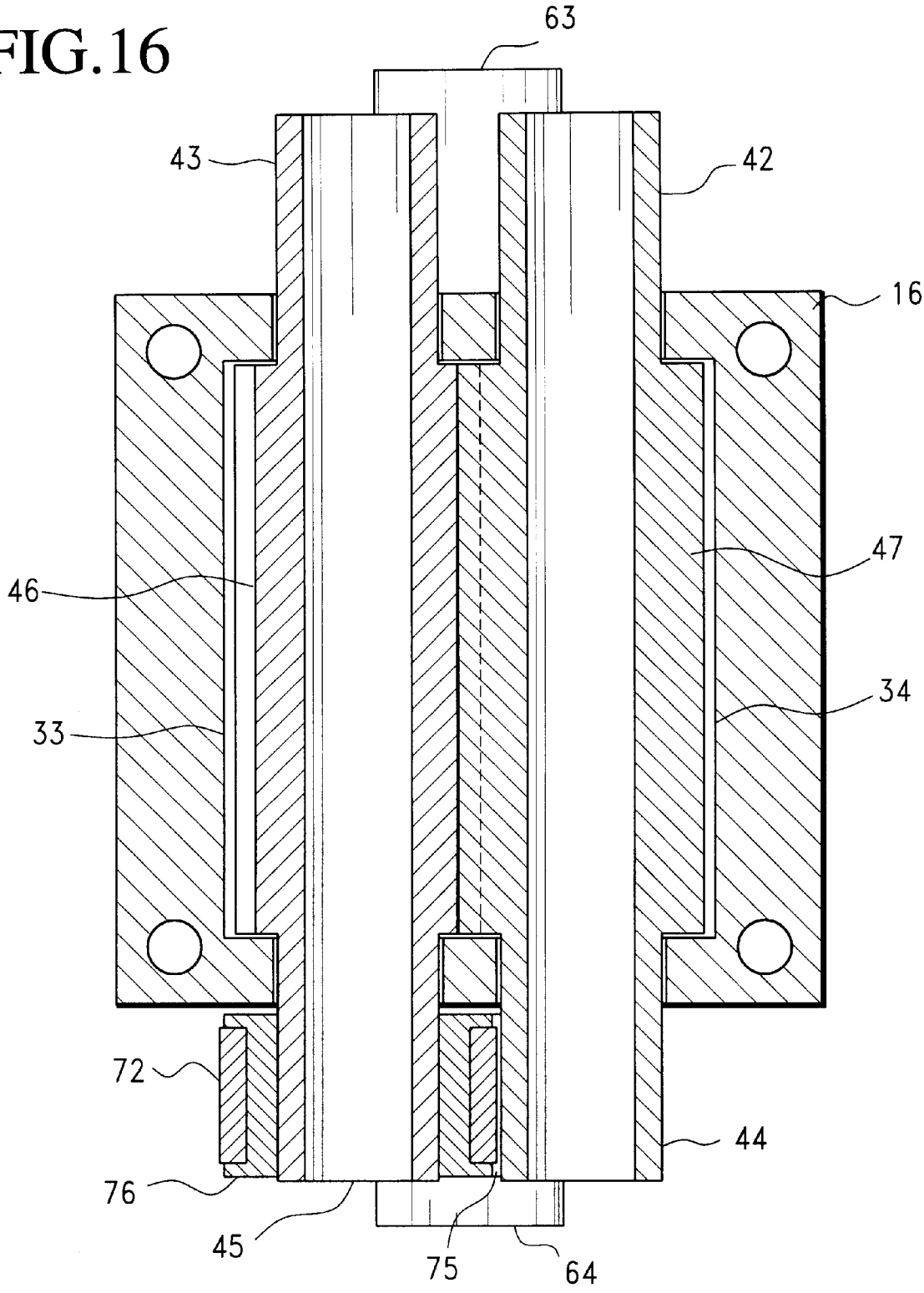
FIG. 16 is a transverse section view taken through a plane indicated by section line 16—16 in FIG. 1.
Figure 17:
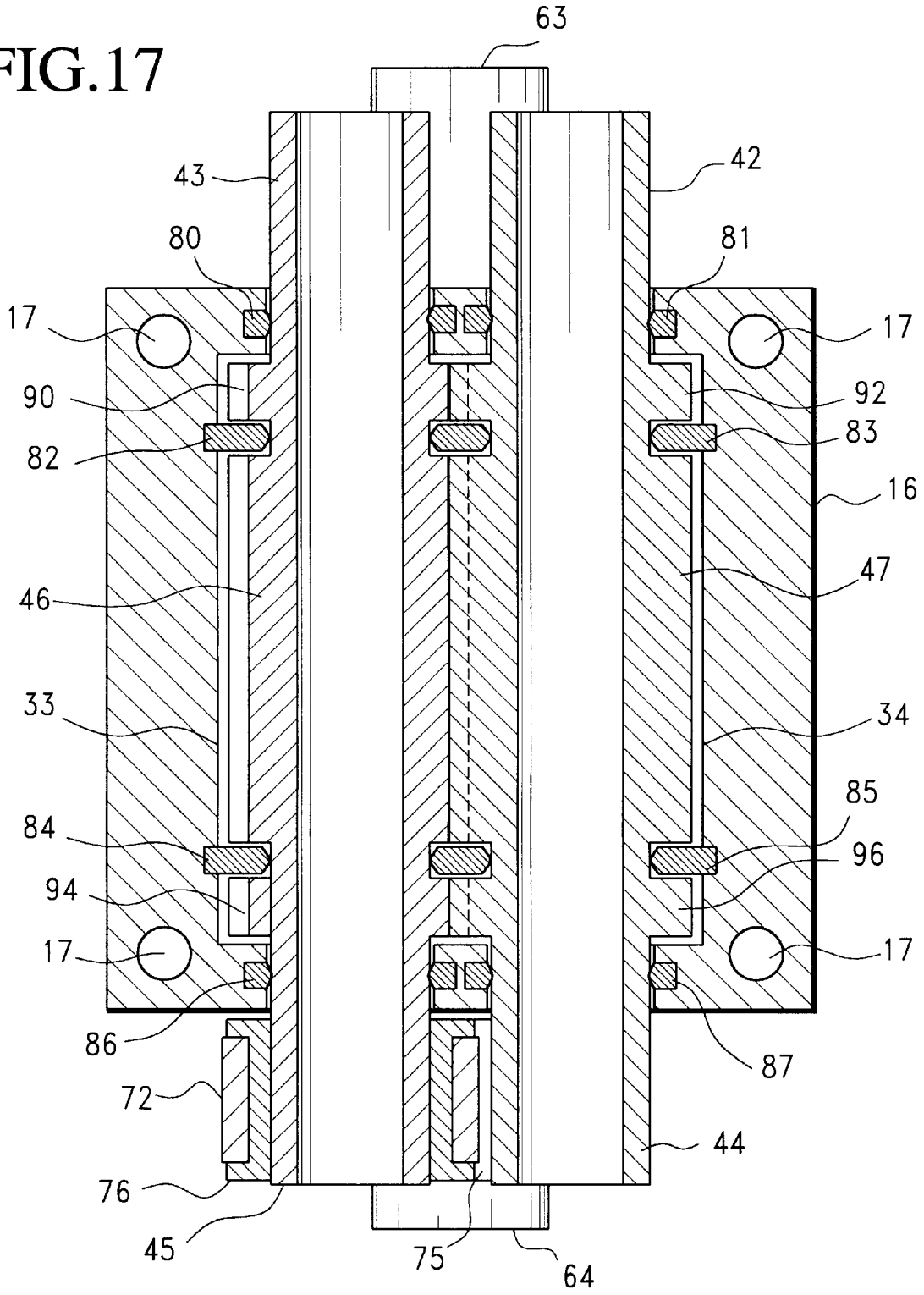
FIG. 17 is a transverse section view taken through a plane indicated by section line 17—17 in FIG. 14.

FIGS. 13, 14 and 15 illustrate different embodiments of the described invention. FIG. 13 shows an embodiment wherein the fuel is injected into the intake port and ignition means placed in the wall of passage 30, for ignition of the fuel mix in passage 30. FIG. 14 shows the embodiment wherein fuel is injected into the passage 30 instead of into the intake port by fuel injector 32, which is located in the rear wall of passage 30. In this embodiment is illustrated in FIG. 17, taken through section lines 17, the two sets of gears to each side of the compressor gears positioned in partial cylinders 33 and 34. These two gear sets are comprised of gears 90, 92, 94, and 96 which are immersed in oil to reduce wear and function as a means to control the rate of wear of the main compressor gears. They can be used to pump cooling oil through the hollow gear shafts and through the oil cooler (not shown) to cool the gear shafts 46 and 47. Oil control rings 80, 81,82, 83, 84, 85, 86, 87 block oil seepage from these gear sets. FIG. 15 shows an embodiment in which ignition means 21 is located in the wall of passage 30 for ignition of the fuel mix compressed into the passage and fuel injector 32 is located at the other end of passage 30 for injection of fuel into passage 30.

While the preferred embodiments of the invention have been shown and described, it is to be understood that the disclosure is for the purpose of illustration and that various changes and modifications may be made without departing from the scope of the invention as set forth in the appended claims.

What is claimed is:

1. In a two stroke internal combustion engine for the generation of useful rotational motion and torque having housing means for enclosing the necessary internal spaces within the engine, crankshaft means for the conversion of reciprocating motion into rotary motion and power output from the engine, reciprocating means for the transfer of energy created by combustion to the crankshaft and for compressing combustible material within the engine for combustion, fuel supply means for supplying fuel for combustion to the engine, air intake means for passing air for combustion into space within the housing, exhaust gas outlet means for passing exhaust gases out of space within the housing, the improvement comprising a crankshaft driven positive displacement gear type air compressor located within the engine housing to compress the air between the reciprocating means and the air compressor having power output shafts.

2. The improvement as defined within claim 1 wherein combustion initiates between the air compressor means and the reciprocating part so power is simultaneously transferred to the reciprocating part and the air compressor gears.

3. The improvement as defined in claim 2 wherein said housing means includes passage means between the compressor means and the reciprocating means for containing compressed air discharged by the air compressor and for receiving a fuel injector nozzle and or spark ignition device.

4. The improvement as defined in claim 3 wherein said passage means includes spark ignition means for initiating the combustion process.

5. The improvement as defined in claim 4 wherein said housing means is formed from two identical parts having identical holes in the outer walls for the passage of output shafts from the air compressor and the crankshaft, and identical openings for the exhaust gas outlet means, for ease of manufacture, assembly and disassembly and includes an internal box having vertical walls for containing the said reciprocating means.

6. The improvement as defined in claim 5 wherein said air compressor is comprised of two identical partial cylinders formed within the engine housing and two identical parallel meshed gear shafts enclosed by the said partial cylinders for compression of the air flowing into the air compressor through the air intake means.

7. The improvement as defined in claim 6 wherein said compressor output shafts are connected by power transfer means to the crankshaft output shaft.

8. The improvement as defined in claim 7 wherein said reciprocating means includes a generally rectangular shaped part having two curved vertical sides, two flat vertical sides and a central depending section having a transverse circular opening for rotational movement around the crankshaft rod journal.

9. The improvement as defined in claim 1 wherein said reciprocating means includes a generally rectangular shaped part having two curved vertical sides, two flat vertical sides and a central depending section having a transverse circular opening for rotational movement around the crankshaft rod journal.

10. The improvement as defined in claim 9 wherein said housing means includes passage means between the compressor means and the reciprocating means for containing compressed air discharged by the air compressor and receiving a fuel injector nozzle and or spark ignition device.

11. The improvement as defined in claim 10 wherein said passage means includes a spark ignition device for initiating combustion within said passage means.

12. The improvement as defined in claim 11 wherein said fuel injection means injects fuel directly into said passage means for combustion of air and fuel within said passage means.

13. The improvement as defined in claim 12 wherein combustion initiates between the air compressor means and the reciprocating part so power is simultaneously transferred to the air compressor gears and the reciprocating part.

14. The improvement as defined in claim 1 wherein said housing means is formed from two identical parts having identical holes in the outer walls for the passage of output shafts from the air compressor and the crankshaft, and identical openings for the exhaust gas outlet means, for ease of manufacture, assembly and disassembly and includes an internal box having vertical walls for containing the said reciprocating means.

15. The improvement as defined in claim 14 wherein combustion initiates between the air compressor means and the reciprocating part so power is simultaneously transferred to the air compressor gears and the reciprocating part during the combustion process.

16. The improvement as defined in claim 15 wherein said housing means includes passage means between the compressor means and the reciprocating means for containing compressed air discharged by the air compressor and receiving a fuel injector nozzle and or spark ignition device.

17. The improvement as defined in claim 16 wherein said fuel injection means injects fuel directly into said passage means for combustion of air and fuel within said passage means.

18. The improvement as defined in claim 1 wherein said housing means includes passage means between the compressor means and the reciprocating means for containing compressed air discharged by the air compressor.

19. The improvement as defined in claim 18 wherein passage means includes a spark ignition device for initiating combustion within said passage means.

20. The improvement as defined in claim 19 wherein said air compressor is comprised of two identical partial cylinders formed within the engine housing and two identical parallel meshed gear shafts enclosed by the partial cylinders for compression of the air flowing into the compressor through the air intake means between the compressor and the said reciprocating means.

21. The improvement as defined in claim 20 wherein combustion initiates between the air compressor means and the reciprocating part so power is simultaneously transferred to the air compressor gears and the reciprocating part during the combustion process.

* * * * *